US005257701A

United States Patent [19]

Edelson

[11] Patent Number: 5,257,701

[45] Date of Patent: Nov. 2, 1993

[54] ADJUSTABLE PORTABLE EXERCISE DESK

[76] Inventor: Nathan Edelson, 526 Hickory St., Missoula, Mont. 59801

[21] Appl. No.: 753,090

[22] Filed: Aug. 30, 1991

[51] Int. Cl.[5] ..... A47F 5/00

[52] U.S. Cl. ..... 211/149; 211/187; 108/111; 108/116; 108/134

[58] Field of Search ..... 211/149, 187, 201; 108/115, 116, 127, 134, 135, 109, 111

[56] References Cited

U.S. PATENT DOCUMENTS

| | | | |
|---|---|---|---|
| 1,861,871 | 6/1932 | Morden | 211/201 |
| 3,252,434 | 5/1966 | Young | 108/111 |
| 3,827,573 | 8/1974 | Guevette | 211/149 |
| 5,056,672 | 10/1991 | Yamada | 211/149 |

OTHER PUBLICATIONS

Edelson & Danoff, "Walking on an Electric Treadmill While Performing VDT Office Work," SIGCHI Bulletin, Jul. 1989, vol. 21 No. 1 pp. 72–77.

Edelson, "Hazards of Sitting Down on the Job," Wall Street Journal, Aug. 31, 1987, Op-Ed Page.

*Primary Examiner*—Robert W. Gibson, Jr.

[57] ABSTRACT

A collapsible desk with unique height adjustment features which allow users to change positions frequently and exercise while they work. The desk may also be used for a variety of other purposes.

15 Claims, 4 Drawing Sheets

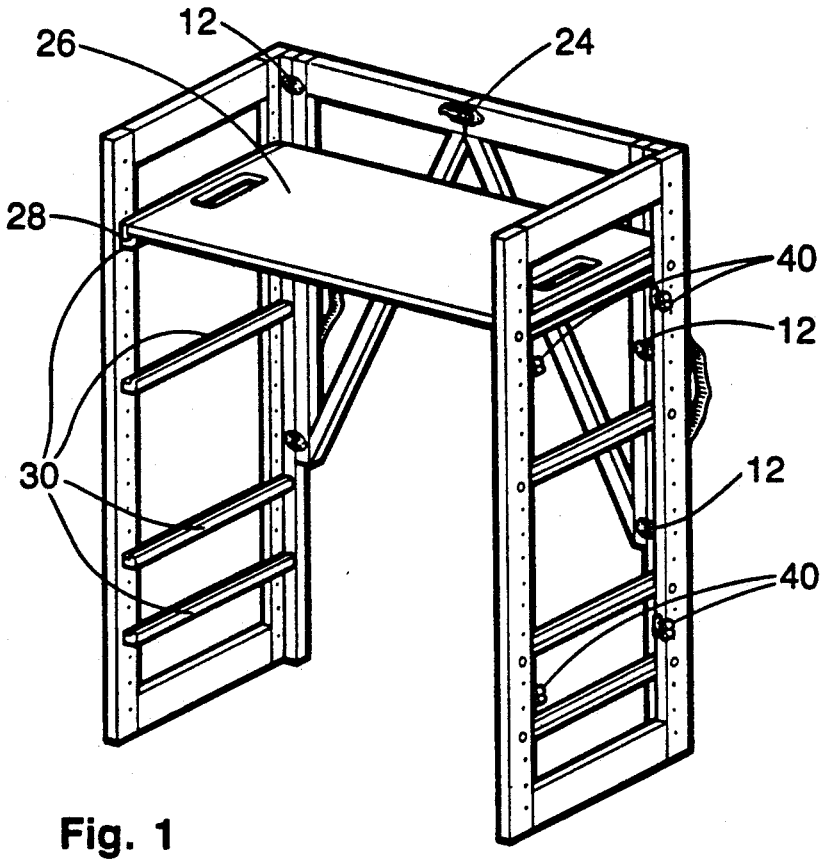
Fig. 1
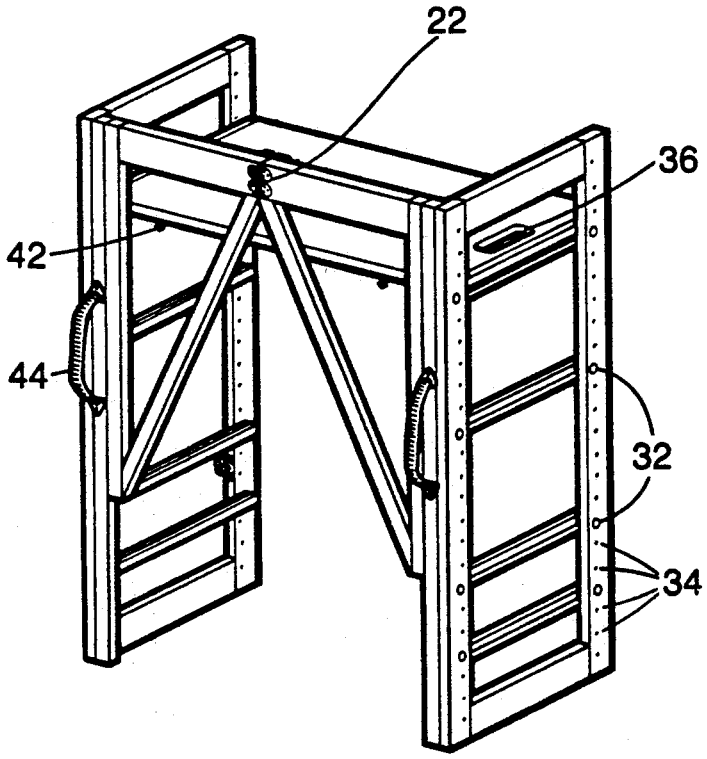
E.R.JENNE
ILLUSTRATOR
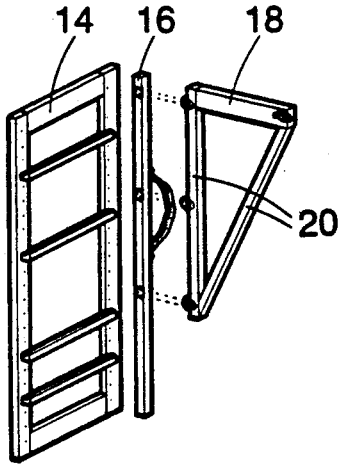
Fig. 3
Fig. 2

ADJUSTABLE PORTABLE EXERCISE DESK

BACKGROUND OF THE INVENTION

Medical science has determined that postural fixity, or the failure to move frequently while performing computer tasks and other desk work, causes or exacerbates back, neck, shoulder, and other body pain.

Heretofore, furniture designed to encourage healthful movement, such as so-called ergonomic chairs and adjustable-height tables, have been ineffective because the amount of movement such furniture allows is not sufficient and/or the furniture is cumbersome to use.

My new adjustable portable exercise desk, however, allows and encourages users to perform significant physical movement while working. It is also light in weight, folds compactly for easy transport and storage, is relatively inexpensive, and is handsome in appearance.

This disk is, moreover, particularly well suited for use with notebook, laptop, and other lightweight computers, portable typewriters, word processors, and the like, which are increasingly taking the place of heavier and bulkier office equipment.

Thus, because my new desk solves an important health problem for a large and growing number of people, I believe it constitutes a new and useful invention, which the following drawings and specifications will also show to be of novel and unobvious design.

BRIEF DESCRIPTION OF THE DRAWINGS

FIG. 1 is a general front oblique view of the desk.

FIG. 2 is a general rear oblique view of the desk.

FIG. 3 is an exploded oblique partial front view showing the construction of the side and half of the back of the desk.

DESCRIPTION OF THE PREFERRED EMBODIMENT

Figure 4B:
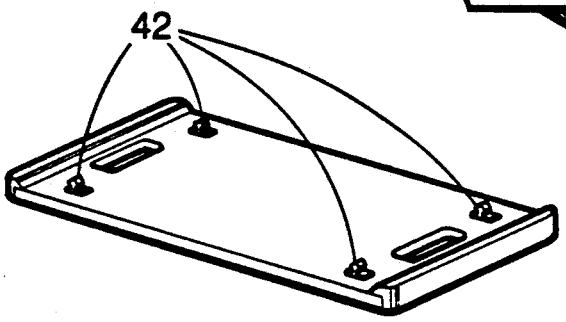
FIG. 4(*a*) shows the top surface and edges of the worksurface of the desk, and FIG. 4(*b*) shows the bottom surface and edges of the worksurface of the desk.

FIGS. 1 and 2 show respectively a front and rear view of my adjustable portable exercise desk. It will be seen to include two parallel sides and a back joined to these sides by three hinges 12.

FIG. 3 further shows the construction of the desk sides and back. Each side consists of a large rectangular element 14, which in a preferred embodiment is assembled from vertical and horizontal rails. This large rectangular element is permanently joined at right angles along a vertical edge to a small strip-like rectangular element 16, which is hinged to one-half of the desk back.

The desk back comprises two mirror-image sections, each of which consists of a horizontal top member 18 which is reinforced by an angular brace 20, the vertical leg of which is hinged to the desk side. The horizontal top members of the respective sides of the desk are hinged to each other along their rear medial vertical edges 22 and secured by a latch 24 spanning their front medial vertical edges.

The desk will be seen to include a worksurface 26 which has protrusion 28 that project from the bottom of each end and fit onto one of several sets of support rails 30. The rails are secured to the desk sides by screws 32 which traverse holes that line the desk sides at regular intervals 34. The worksurface is further provided with hand-hold cutouts 36 to allow for easy repositioning.

One side of the desk is equipped with four roller catches 40 which line up with mating catch pieces on the underside of the worksurface 42 so it may be secured to the desk side for transport and storage. The desk also has a set of handles 44 so it may be easily carried when collapsed.

Figure 4A:
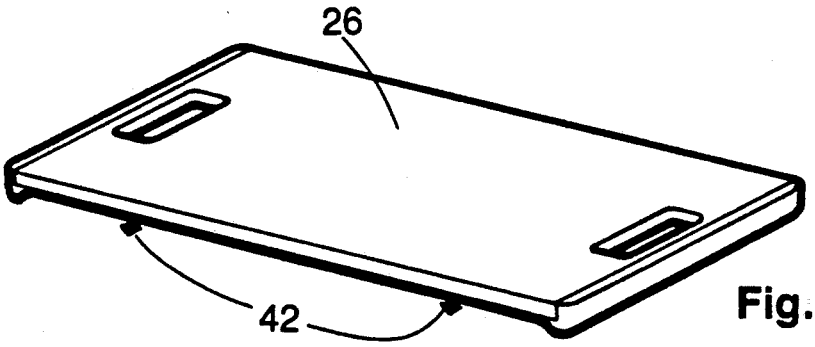

FIG. 4(*a*) shows the top of the worksurface 26 in greater detail, and FIG. 4(*b*) shows the underside of the worksurface with attention to the four mating catch pieces 42 previously mentioned.

Figure 5:
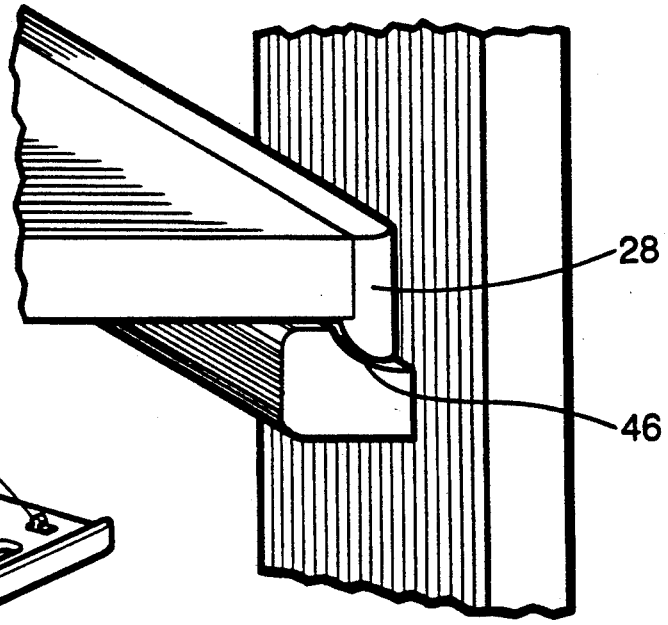
FIG. 5 is a detail showing how the worksurface fits onto the support rails of the desk.

FIG. 5 shows how the protrusions 28 on the ends of the worksurface fit into the approximately quarter-round beveled sections 46 of the worksurface support rails. Thus the worksurface acts to connect and stabilize the two sides of the desk while permitting the user to change the height of the worksurface by simply lifting or sliding it off the support rails.

Figure 6:
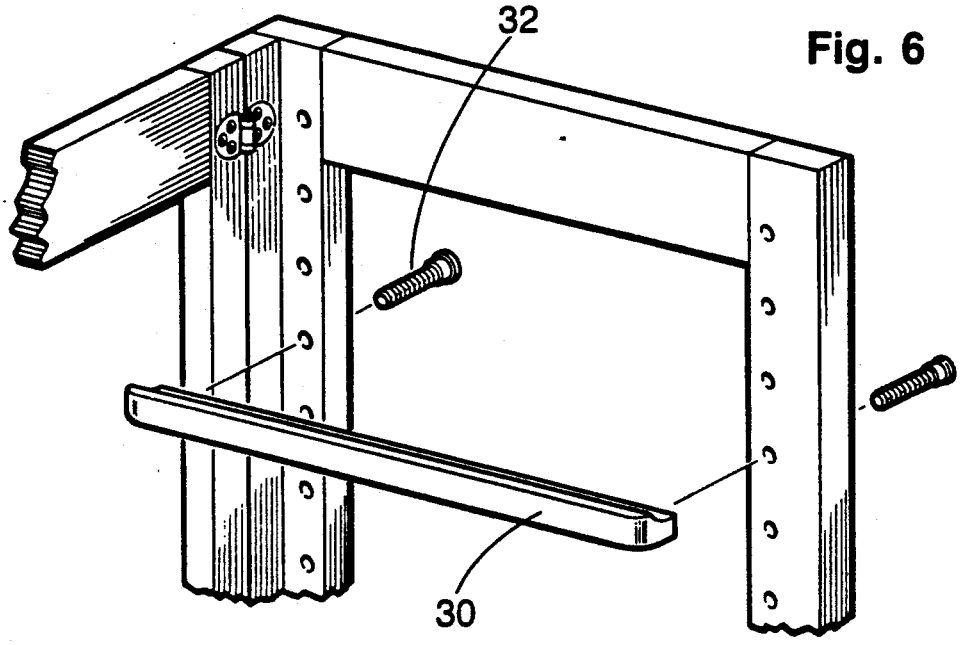
FIG. 6 is a detail showing how the rails are secured to the sides of the desk.

FIG. 6 shows how the rails 30 are secured to the desk side with screws 32 at any desired height. In a preferred embodiment the desk is provided with four sets of rails, however, a greater or lesser number may be utilized.

Figure 7:
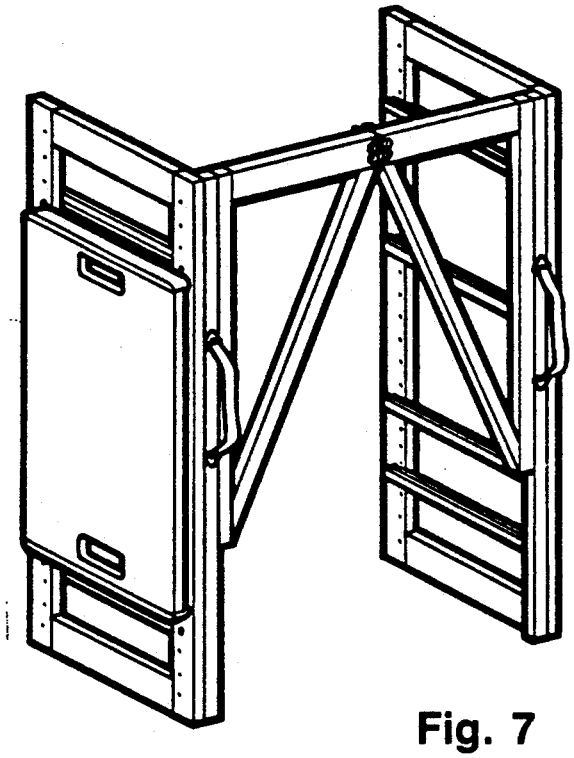
FIG. 7 shows how the worksurface may be secured to one side of the desk for transport and storage.
Figure 8:
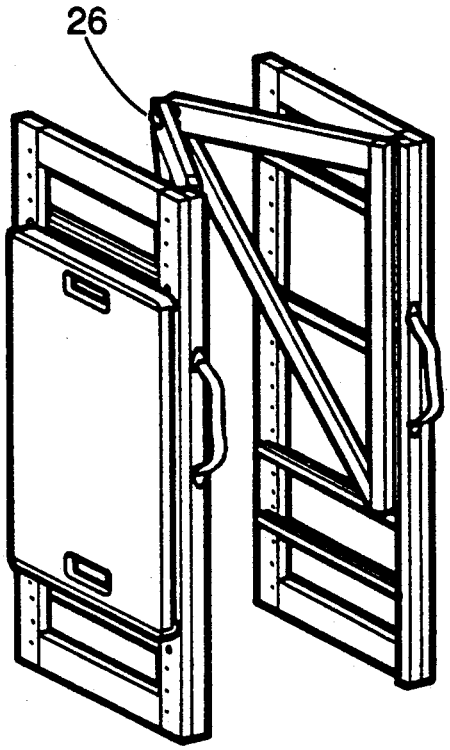
FIG. 8 shows the desk partially collapsed.
Figure 9:
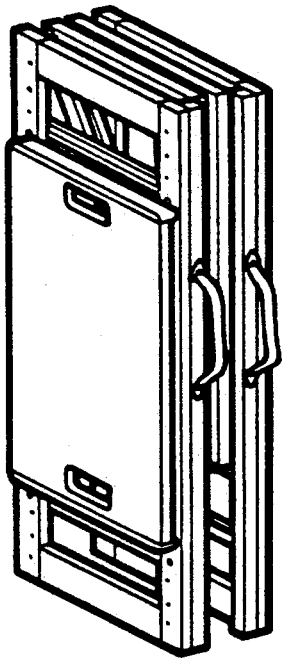
FIG. 9 shows the desk fully collapsed.
Figure 10:
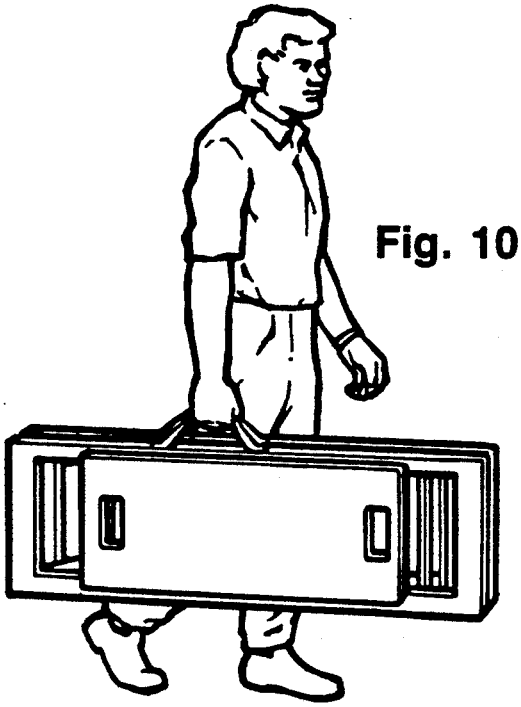
FIG. 10 shows the desk fully collapsed and being carried by its handles.

FIG. 7 shows the desk with the worksurface secured to its side. FIG. 8 shows the medial latch 26 unfastened and the desk in a semi-collasped position. FIG. 9 shows the desk in a fully collapsed position, and FIG. 10 shows it being carried in this position by the handles.

Figure 11:
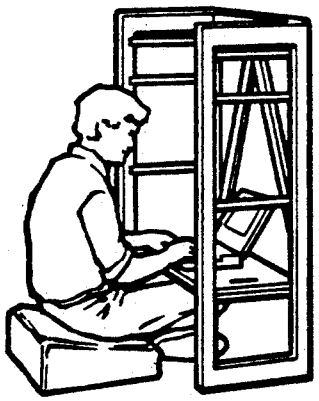
FIG. 11 shows the desk used in a floor-based position.
Figure 12:
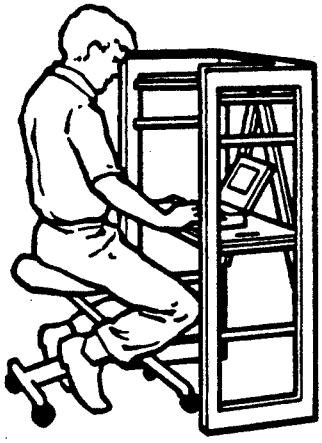
FIG. 12 shows the desk used in a conventional-height seated position.
Figure 13:
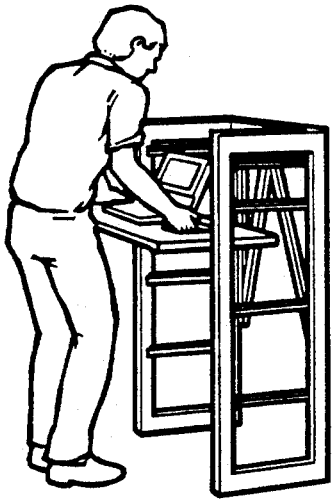
FIG. 13 shows the worksurface of the invention being repositioned between two heights.

FIG. 11 shows the desk being used with the worksurface positioned on a low set of rails for sitting on a floor cushion. FIG. 12 shows the worksurface at conventional desk height being used with a kneeling chair. FIG. 13 shows the user midway in the process of changing the height of the worksurface from a sitting to a standing height. Note that it is not necessary to remove the computer from the worksurface during this procedure.

Figure 14:
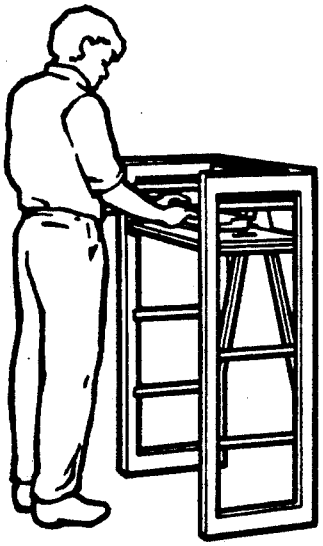
FIG. 14 shows the desk used while standing.
Figure 15:
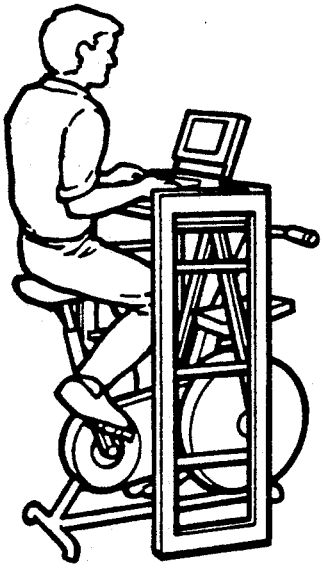
FIG. 15 shows the desk used while pedaling a stationary bicycle.
Figure 16:
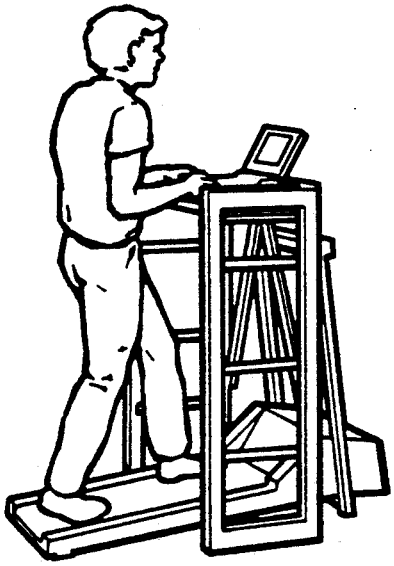
FIG. 16 shows the desk used while walking on a treadmill.

FIG. 14 shows the worksurface positioned on rails so it may be comfortably used at standing height. FIGS. 15 and 16 show the worksurface positioned at its greatest height so a user may pedal a stationary bicycle or walk on a treadmil concomitantly with working. It will be noted that the exercise machines fit readily under the relatively open back of the desk.

In a preferred embodiment, the portable adjustable exercise desk is approximately 48" high, 32" wide, and 16" deep; dimensions that conform to utility and comfort when using a notebook computer; the desk may, however, be of other dimensions. In a preferred embodiment, the sides and back of the desk are constructed of oak or other hardwood, and the worksurface is constructed of reinforced hollow-core hardwood-laminate veneer, so as to minimize its weight and provide for its easy repositioning at different heights.

In the above-described embodiment, the entire desk with worksurface weighs about twenty pounds, however, for additional lightness, aesthetics or utility, the desk may be also be constructed from materials other than wood, such as metals or plastics, or combinations thereof.

Although the description above contains many specificities, these should not be construed as limiting the scope of my invention but as merely providing illustration of some of its present preferred embodiments and uses. Other embodiments and users are contemplated, for example, in its above described or somewhat modified form my invention may also be used as a shelving and/or storage system, a reading desk, a display module, a speaker's stand, a food or drink bar, and in a variety of other useful ways.

Thus the scope of my invention should be determined by the appended claims and their legal equivalents, rather than by the examples given.

I claim:

1. An adjustable portable exercise desk comprising
two side elements of approximately equal size,
a foldable back member comprising two halves interconnected by a hinge,
two further sets of hinges, each set interconnecting a respective one of said side members to a respective one of said back halves,
at least two horizontal support rails, and means on the side elements for securing said rails thereto at any of a plurality of discrete heights, and
a work surface which may be slidingly installed on said support rails, said work surface having downwardly extending right and left flanges engageable with said rails, said flanges and rails having interlocking profiles.

2. The invention of claim 1, wherein each side element comprises a rectangular frame and a spacer strip permanently affixed along one side of the frame, to one side thereof, and said rails are affixed to the frame on the same side, said spacer strip having a width approximately equal to the width of the support rails.

3. The invention of claim 1, wherein each of said side elements has at least one series of holes therein at regular intervals along its height, and said support means are inserted into selected ones of said holes.

4. The invention of claim 1, wherein each of said back halves includes a horizontal member hinged to its counterpart on the other member.

5. The invention of claim 4, further comprising diagonal braces affixed to and below each of said horizontal members, so as to leave an open space below the back halves for exercise equipment, whereby one may exercise while working at the desk.

6. The invention of claim 4, wherein said horizontal members are hinged at their rear medial edges, and further comprising a fastener having mating portions on front medial edges thereof, for locking the horizontal members in place when the back is unfolded.

7. The invention of claim 6, wherein the fastener is a draw latch.

8. The invention of claim 1, wherein each of said rails has a beveled upper surfaces descending toward said side element frame.

9. The invention of claim 1, wherein each of said rails has a rounded upper surface.

10. The invention of claim 1, wherein said work surface comprises handle means.

11. The invention of claim 10, wherein said handle means are two handle holes cut through the work surface, one at either end thereof.

12. The invention of claim 1, further comprising means for attaching said work surface to one of said side members during transport and storage.

13. The invention of claim 12, wherein said attaching means comprises four twin roller catches.

14. The invention of claim 1, further comprising at least one handle attached to one of said side members, to facilitate carrying of the desk in its collapsed state.

15. The invention of claim 1, further comprising a pair of handles for carrying the desk in its collapsed state, each of said handles being connected to a vertical face of a respective side member.

* * * * *